US007255607B1

(12) United States Patent
Wu

(10) Patent No.: US 7,255,607 B1
(45) Date of Patent: Aug. 14, 2007

(54) COMPATIBLE ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/633,815

(22) Filed: Dec. 5, 2006

(51) Int. Cl.
*H01R 24/00* (2006.01)

(52) U.S. Cl. ..... 439/660

(58) Field of Classification Search ..... 439/660, 439/108, 607, 497, 101
See application file for complete search history.

(56) References Cited

U.S. PATENT DOCUMENTS

| | | | | |
|---|---|---|---|---|
| 4,867,690 | A * | 9/1989 | Thumma | 439/79 |
| 5,356,300 | A * | 10/1994 | Costello et al. | 439/101 |
| 5,697,799 | A * | 12/1997 | Consoli et al. | 439/181 |
| 6,832,934 | B1 * | 12/2004 | Zhang | 439/660 |
| 6,910,914 | B1 | 6/2005 | Spink, Jr. | |
| 6,913,489 | B2 | 7/2005 | Chai et al. | |
| 7,097,507 | B1 | 8/2006 | Zhang et al. | |
| 2007/0049118 | A1 * | 3/2007 | Reeser et al. | 439/608 |

* cited by examiner

*Primary Examiner*—Phuong Dinh
(74) *Attorney, Agent, or Firm*—Wei Te Chung

(57) ABSTRACT

An electrical connector (100) in accordance with the present invention is adapted for connecting with an electronic element and capable of mating with at least one of the first and second complementary connectors. The electrical connector includes a housing (2), a number of first terminals (41) and at least one second terminal (42). The housing includes an upper wall (21), a lower wall (22) opposite to the upper wall, and a pair of sidewalls (23) connecting with the upper and lower walls. The housing defines a receiving space (20) circumscribed by the upper wall, the lower wall and the sidewalls. The first terminals are assembled to the upper wall of the housing, and at least one second terminal is assembled to the housing. Each terminal includes a mating portion (40), an intermediate portion (43) engaging with the housing to retain the first and second terminals in the housing and a tail portion (44) adapted for electrically connecting with the electronic element. The mating portions of the first terminals are exposed beyond inner surface of the upper wall and exposed into the receiving space of the housing adapted for mating with the first complementary connector, and the mating portion of the at least one second terminal is exposed beyond the outer surface of the housing adapted for mating with the second complementary connector together with the first terminals.

2 Claims, 13 Drawing Sheets

COMPATIBLE ELECTRICAL CONNECTOR

BACKGROUND OF THE INVENTION

1. Field of the Invention

The present invention generally relates to an electrical connector, and more particularly to a compatible electrical connector used for mating with different connectors in different applications.

2. Description of Related Art

Serial ATA connectors in accordance with Serial ATA specification are widely used in desktops currently for transmitting signals from motherboard to HDD or transmitting power from power supply of the computer to the HDD, or transmitting signals or power between outer HDD to the computer. When the Serial ATA connectors used in external applications, current designs usually are single connector comprising signal and grounding contacts for signal transmission or single connector comprising power contacts for different-voltage power transmission. However, in some applications, the connector transmitting signals needs to be combined with power transmission. There is no such a connector complying with such demands. Thus, an improved connector is needed to be designed for being compatible with complementary connector with or without power contacts.

BRIEF SUMMARY OF THE INVENTION

Accordingly, an object of the present invention is to provide an electrical connector compatible with different connectors.

In order to achieve the above-mentioned object, an electrical connector in accordance with the present invention is adapted for connecting with an electronic element and capable of mating with at least one of the first and second complementary connectors. The electrical connector comprises a housing, a plurality of first terminals and at least one second terminal. The housing comprises an upper wall, a lower wall opposite to the upper wall, and a pair of sidewalls connecting with the upper and lower walls. The housing defines a receiving space circumscribed by the upper wall, the lower wall and the sidewalls. The first terminals are assembled to the upper wall of the housing, and at least one second terminal is assembled to the housing. Each terminal comprises a mating portion, an intermediate portion engaging with the housing to retain the first and second terminals in the housing and a tail portion adapted for electrically connecting with the electronic element. The mating portions of the first terminals are exposed beyond inner surface of the upper wall and exposed into the receiving space of the housing adapted for mating with the first complementary connector, and the mating portion of the at least one second terminal is exposed beyond the outer surface of the housing adapted for mating with the second complementary connector together with the first terminals.

Other objects, advantages and novel features of the invention will become more apparent from the following detailed description of the present embodiment when taken in conjunction with the accompanying drawings.

DETAILED DESCRIPTION OF THE INVENTION

Figure 1:
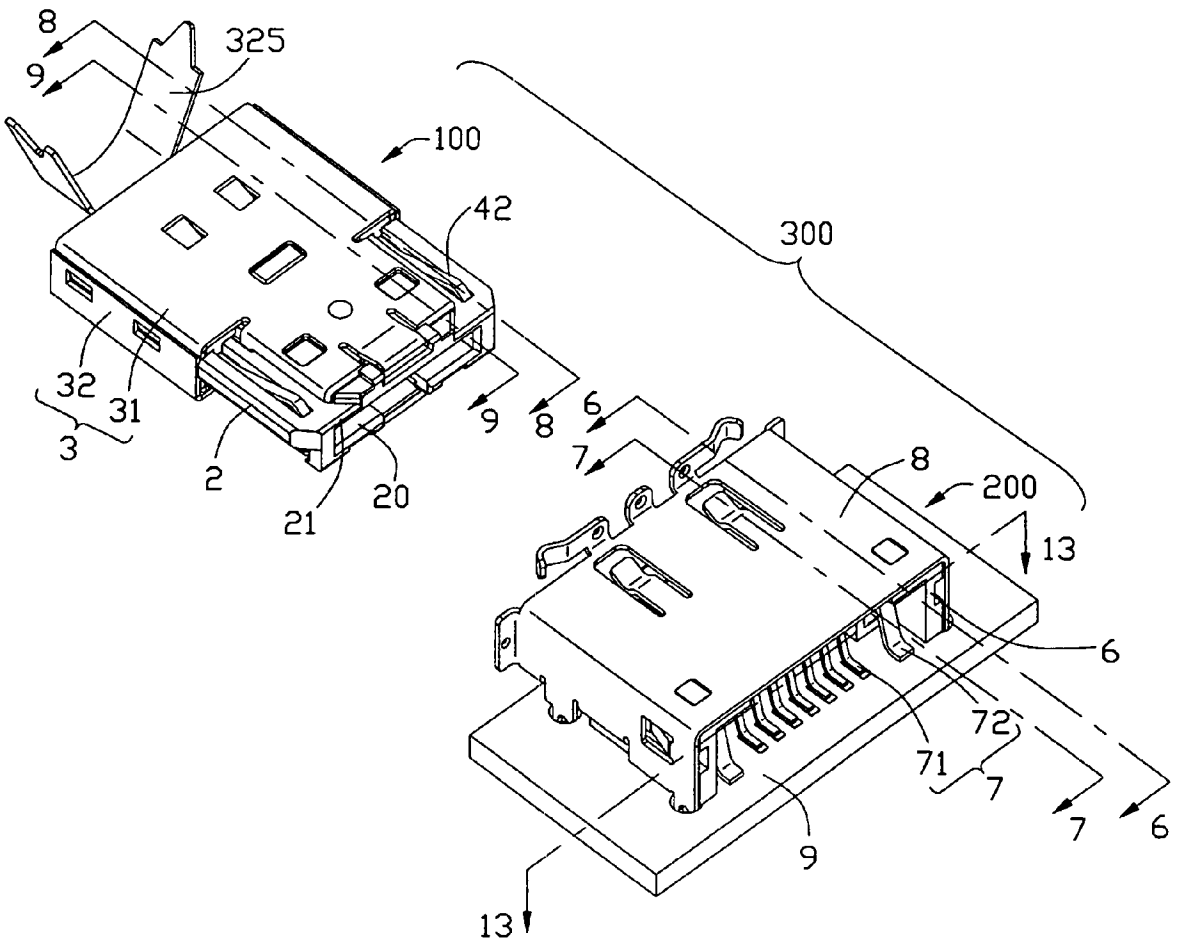
FIG. 1 is a perspective view of an electrical connector assembly in accordance with the present invention.

Reference will now be made to the drawing figures to describe the present invention in detail.

Referring to FIGS. 1-4, an electrical connector assembly 300 in accordance with the present invention comprises a plug connector 100 and a board end connector 200 engaging with the plug connector 100.

Figure 4:
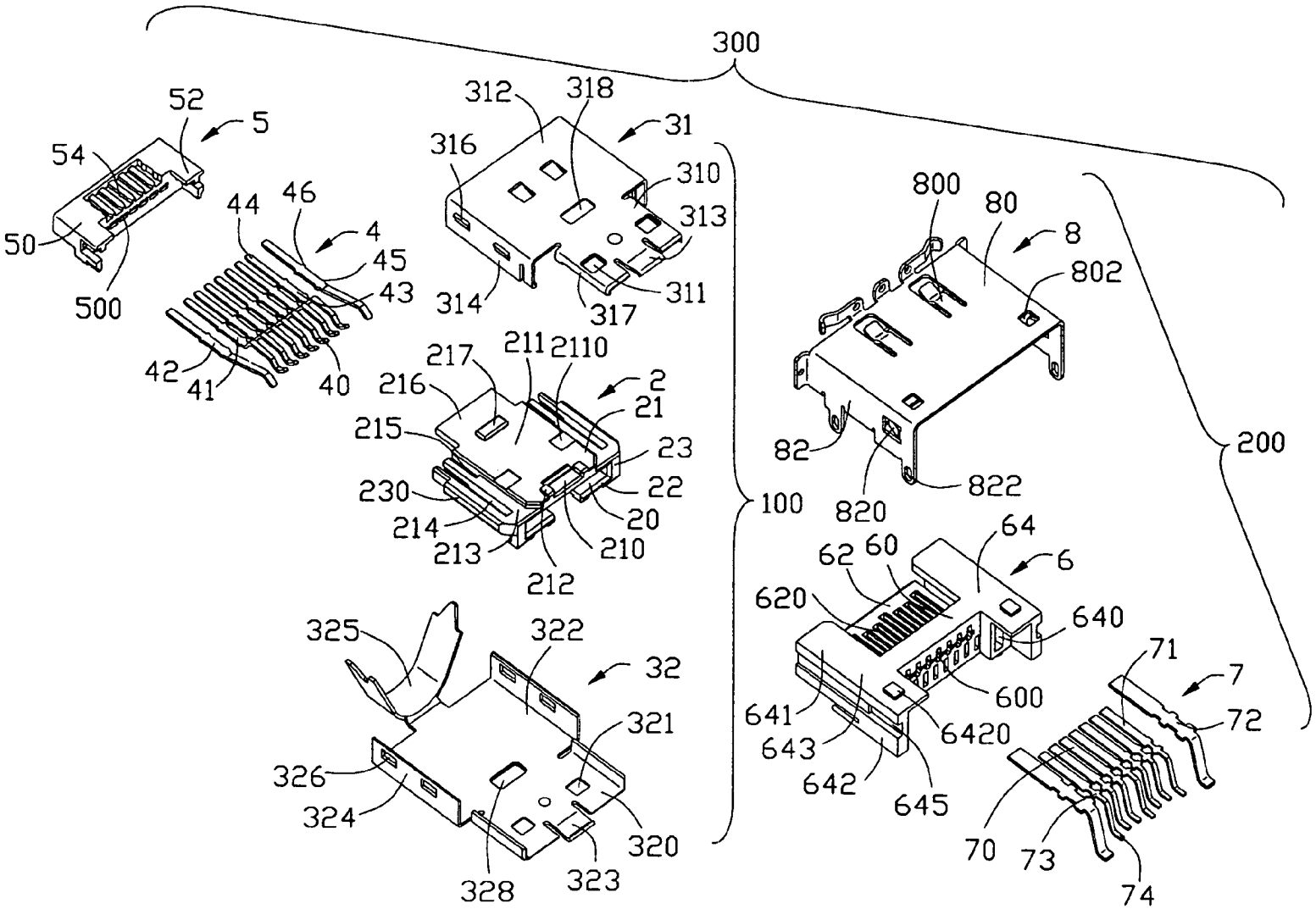
FIGS. 4-5 are exploded, perspective views of the electrical connector assembly with a printed circuit board not shown.
Figure 5:
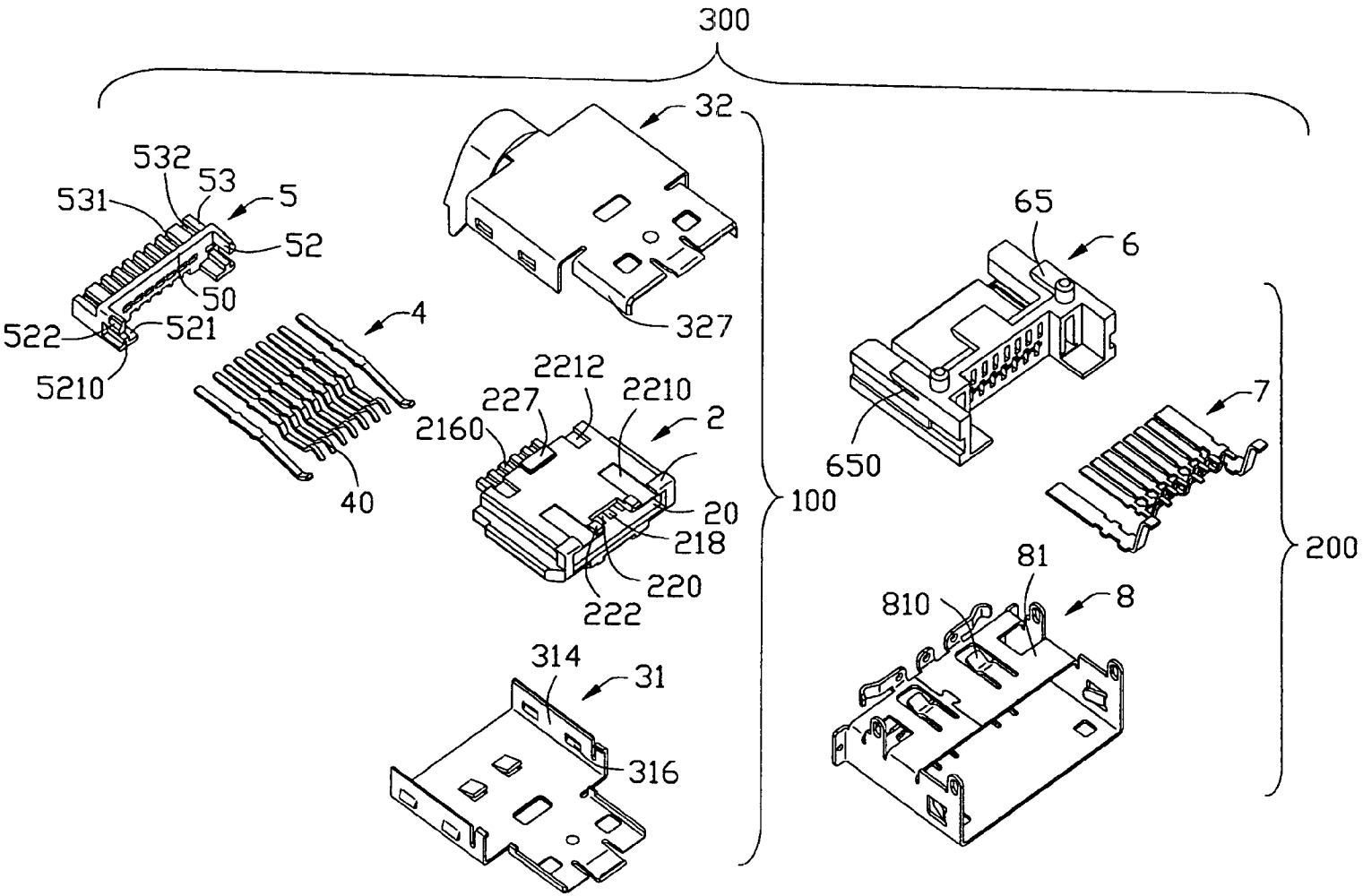

Now referring to FIGS. 4-5, the plug connector 100 comprises a first housing 2, a plurality of terminals 4 assembled to the first housing 2, a spacer 5 trimming tail portions of the terminals 4 and assembled to the first housing 2, a cable (not shown) soldered with the terminals 4 in the spacer 5, and a conductive shell 3 enclosing the first housing 2, the terminals 4 and the spacer 5. The board end connector 200 comprises a second housing 6, a plurality of contacts 7 assembled to the second housing 6 and soldered to a printed circuit board 9, and a shielding member 8 shielding the second housing 6 and the contacts 7.

Referring to FIGS. 4-5 in conjunction with FIGS. 8-12, the first housing 2 of the plug connector 100 comprises an upper wall 21, a lower wall 22 opposite to the upper wall 21, and a pair of sidewalls 23 connecting with the upper and lower walls 21, 22. A pair of guiding posts 230 with tapered forward ends is formed with the sidewalls 23 for guiding the insertion of the plug connector 100 to the board end connector 200. Each guiding post 230 is coplanar with the upper surface of the upper wall 21 and has a distance to the bottom surface of the lower wall 22. A rectangular receiving space 20 is circumscribed by the walls 21, 22, 23.

The upper wall 21 defines a plurality of first channels 218 recessed upwardly from inner surface thereof to communicate with the receiving space 20 and a pair of second channels 214 recessed downwardly from upper surface thereof and located at opposite sides of the first channels 218. The pair of second channels 214 are respectively partially recessed into the pair of sidewalls 23 and in no communication with the receiving space 20. A rectangular platform 211 is formed with the upper wall 21 and extending beyond the rear edge of the upper wall 21 a certain distance to form an stretching portion 216 and higher than the upper surface of the upper wall 21. The stretching portion 216 is slotted to form a plurality of ribs 2160 and slots aligning with the first channels 218. The lateral edges of the platform 211 respectively has a distance from the second channels 214 along the lateral direction. A first recess 210 is defined in the front portion of the platform 211 and recessed downwardly a certain distance from upper surface of the platform 211. A pair of first protrusions 212 is formed at opposite sides of the first recess 210. A pair of first grooves 2110 is defined in a middle area of the platform 211 and communicates with the lateral edges, respectively. A first tuber 217 is formed on a rear area of the platform 211 and located adjacent to the rear edge of the upper wall 21. Two pairs of slits 215 are defined in rear portion of the upper wall 21 with one pair located adjacent to the lateral edges of the platform 211 and one pair further recessed from inner periphery of the second channels 214. A second recess 220 and a pair of second protrusions 222 are respectively formed with the lower wall 22 corresponding to the first recess 210 and the first protrusions 212. A pair of front second grooves 2210 and a pair of rear third grooves 2212 respectively defined in the lower wall 22 and a second tuber 227 is formed on the lower wall 22 corresponding to the first tuber 217.

The terminals 4 of the plug connector 100 consist of a plurality of first terminals 41 and a pair of second terminals 42 located at outer sides of the first terminals 41 for power transmission. The first terminals 41 consists of two pairs of differential pairs for signal transmission and three grounding terminals located at opposite sides of the differential pairs. Each terminal 4 comprises a curved mating portion 40, a tail portion 44 and an intermediate portion 43 interconnecting the mating portion 40 and the tail portion 44. The intermediate portion 43 forms a pair of first barbs 45 and a pair of second barbs 46 spaced arranged thereon. The first terminals 41 are arranged with the same intervals, while the second terminals 42 are arranged with larger intervals. In addition, The curved directions of the mating portions 40 of the first and second terminals 41, 42 are opposite, that is to say, the curved direction of the first mating portion 40 is downward, and the curved direction of the second mating portion 40 is upward.

When assembled to the first housing 2, the first and second terminals 41, 42 respectively protrude through the first and second channels 218, 214 with the mating portions 40 of the first terminals 41 exposed into the receiving space 20 while the mating portions 40 of the second terminals 42 exposed beyond the second channels 214 to be higher than the upper surface of the upper wall 21. The first barbs 45 of the intermediate portions 43 respectively engage with the first and second channels 218, 214 for retaining the terminals 4 in the first housing 2. The tail portions 44 extend beyond the rear face of the first housing 2. In addition, the pair of second terminals 42 transmits current at 5 v. In alternative embodiments, the second terminals also can transmit power at other voltages.

The spacer 5 comprises a body portion 50, a board portion 53 extending rearwardly from the body portion 50, and a pair of arms 52 extending forwardly from the body portion 50. A plurality of first through holes 500 extending through the body portion 50 and aligning with the first channels 218, and a pair of second through holes 502 protrude through the body portion 50 and aligning with the second channels 214 of the first housing 2. A plurality of first passages 531 and a plurality of second passages 532 respectively defined in one side of the board portion 53 and respectively communicating with the first and second through holes 500, 502. Each arm 52 comprises a first arm section 521 with large area and formed with a guiding rib 5210, and a second arm section 522 aligned with the first arm section 521 along vertical direction.

Figure 12:
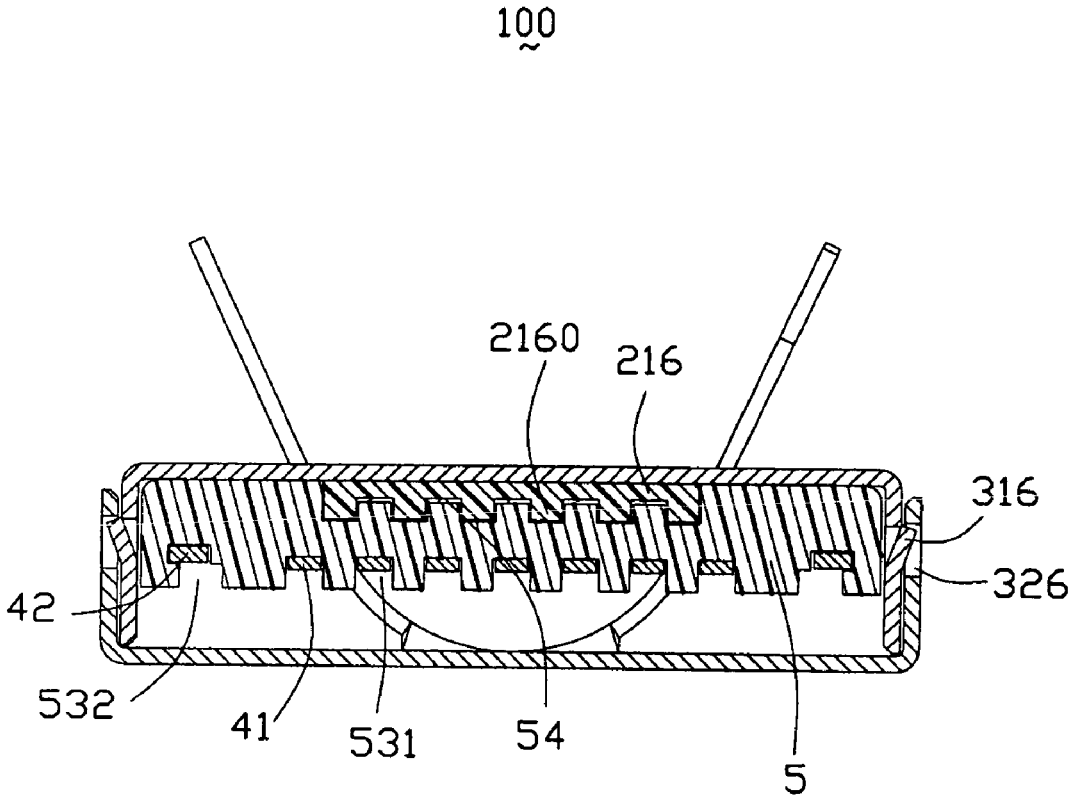
Figure 13:
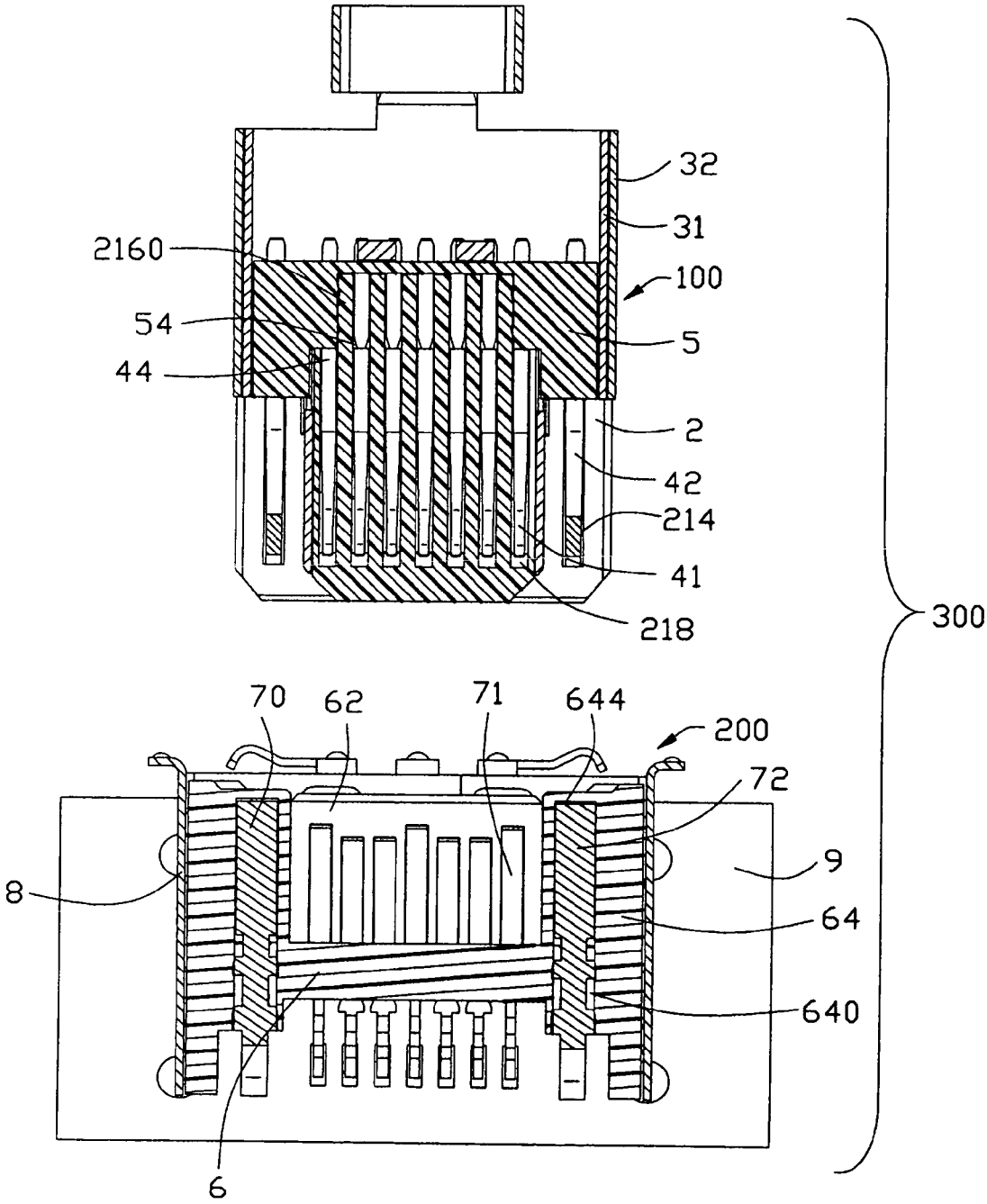
FIG. 13 is a cross-section view taken along line 13-13 of FIG. 1.

When the spacer 5 is assembled to the first housing 2, the guiding ribs 5210 of the arms 52 slide along the outer pair of slits 215 and the rear end of the first housing 2 is sandwiched between the first and second arm sections 521, 522 of the spacer 5. The tail portions 44 of the first and second terminals 41, 42 respectively protrude through the first and second through holes 500, 502 with the second barbs 46 interferentially engaging with the first and second through holes 500, 502 to enhance the engagement between the terminals 4 and the spacer 5. After the terminals 4 protrude through the first and second through holes 500, 502, the tail portions 44 of the first and second terminals 41, 42 located in corresponding first and second passages 531, 532 of the board portion 53 of the spacer 5. In the area of the board portion 53, wires of the cable (not shown) are soldered to the terminals 4. Thus, the spacer 5 trims and aligns the tail portions 44 of the terminals 4 for soldering conveniently. For enhancing the engagement between the spacer 5 and the first housing 2, the spacer 5 defines a plurality of grooves 54 on upper surface thereof to respectively receive the extrusions 2160 (FIG. 12 and FIG. 13).

The conductive shell 3 of the plug connector 100 comprises a first shell half 31 and a second shell half 32 engagable with the first shell half 31 for shielding the plug connector 100. Each of the first and second shell halves 31, 32 comprises a U-shape first/second front portion 310, 320 and a U-shape first/second rear portion 312, 322 wider and longer than the first/second front portion 310, 320. The first/second front portion 310, 320 defines a pair of first/second notches 311, 321 corresponding to the pair of first/second grooves 2110, 2210 of the first housing 2 and a first/second spring piece 313, 323 split from a front portion thereof and received in the first/second recess 210, 220 of the first housing 2 and positioned by the pair of first/second protrusions 212, 222. The pair of vertical flanges 317 of the first front portion 310 respectively cover the lateral flanges of the platform 211 with rear ends protruding into the inner pair of slits 215 to retain the first shell half 31 to the first housing 2. The pair of vertical flanges 327 of the second front portion 320 respectively cover the sidewalls 23 of the first housing 2. The first/second rear portion 312, 322 defines a rectangular first/second window 318 receiving the first/second tuber 217, 227 of the first housing 2 to position the first/second shell half 31, 32 to the first housing 2. Each vertical flange 314 of the first rear portion 312 forms a pair of wedges 316 thereon, and each vertical flange 324 of the second rear portion 322 defines a pair of cutouts 326 receiving the pair of wedges 316 to make reliable engagement between the first and second shell halves 31, 32. The second shell half 32 further forms a strain relief section 325 behind the second rear portion 322 for grasping the cable to provide strain relief to the cable.

Figure 6:
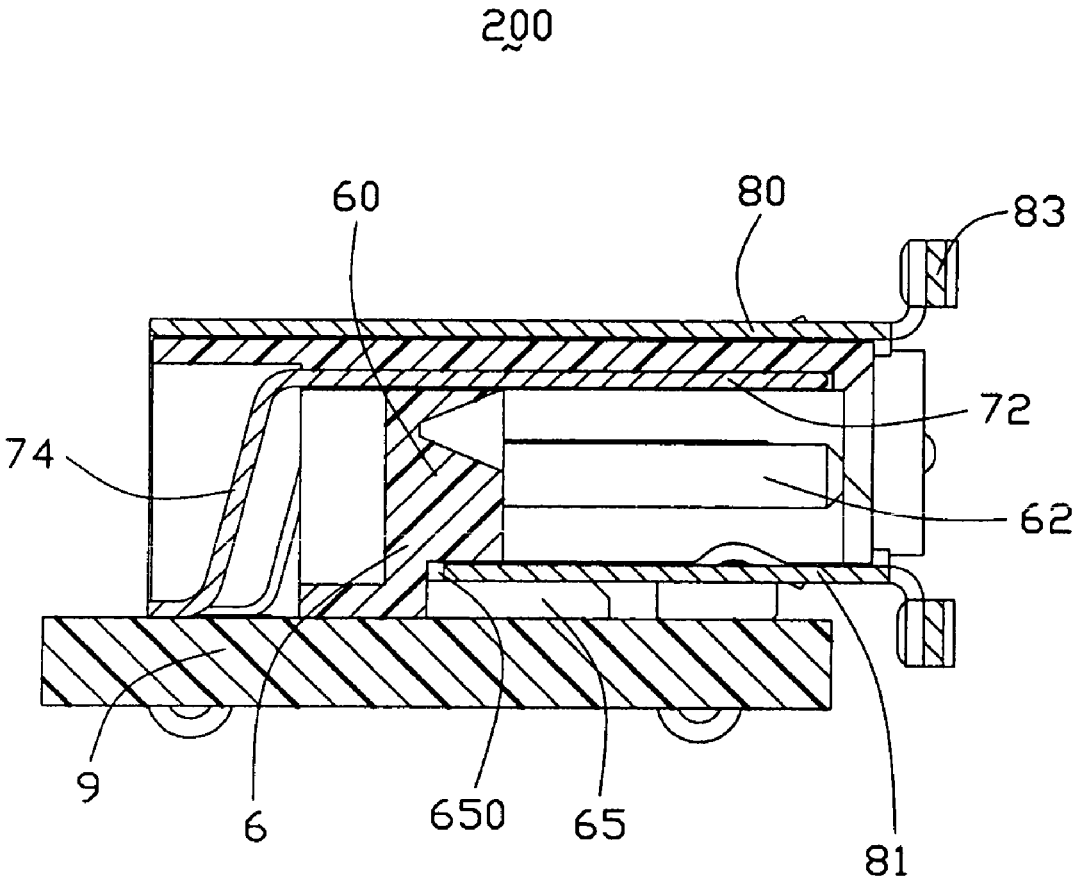
FIGS. 6-7 are cross-sectional views taken along lines 6-6 to 7-7 of FIG. 1.
Figure 7:
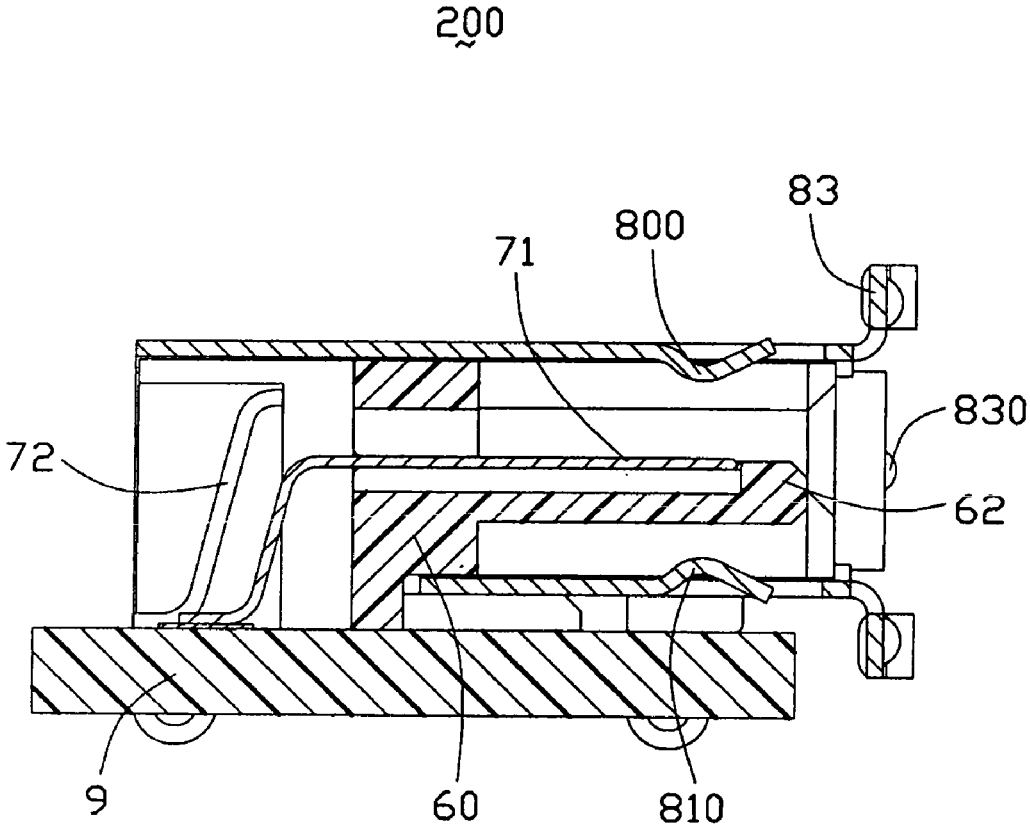
Figure 8:
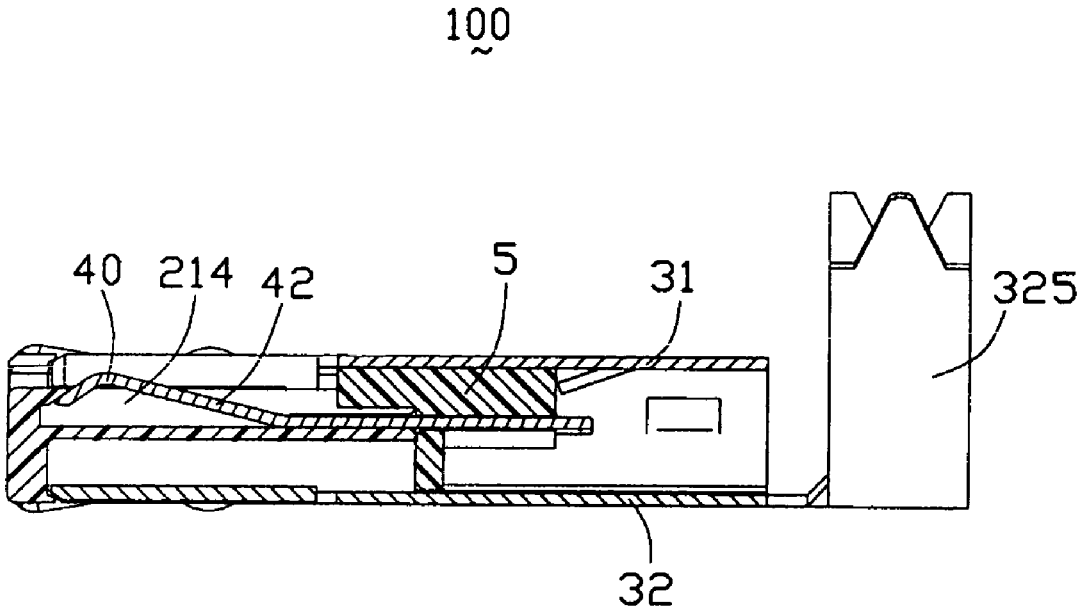
FIGS. 8-12 are cross-section views taken along lines 8-8 to 12-12 of FIGS. 1-2.
Figure 9:
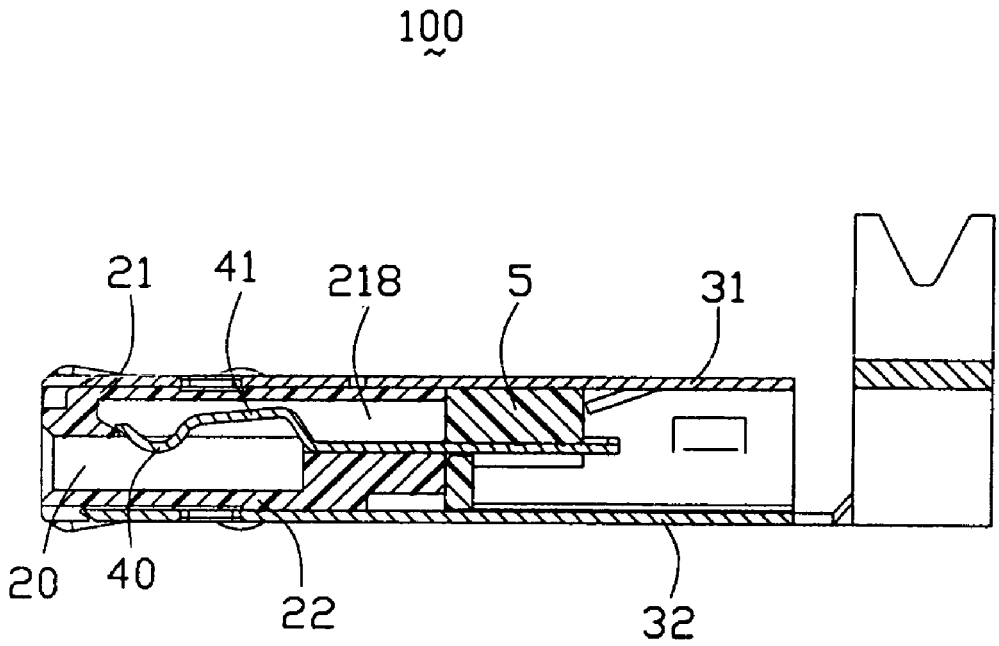
Figure 10:
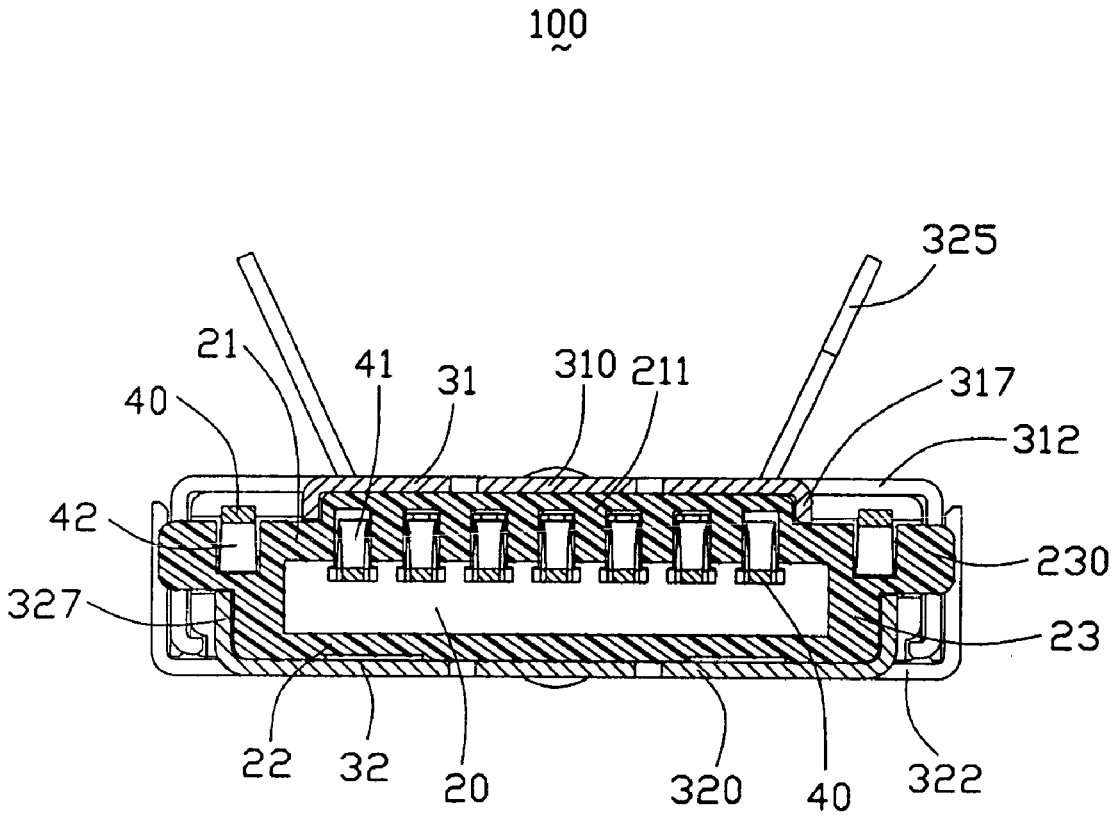
Figure 11:
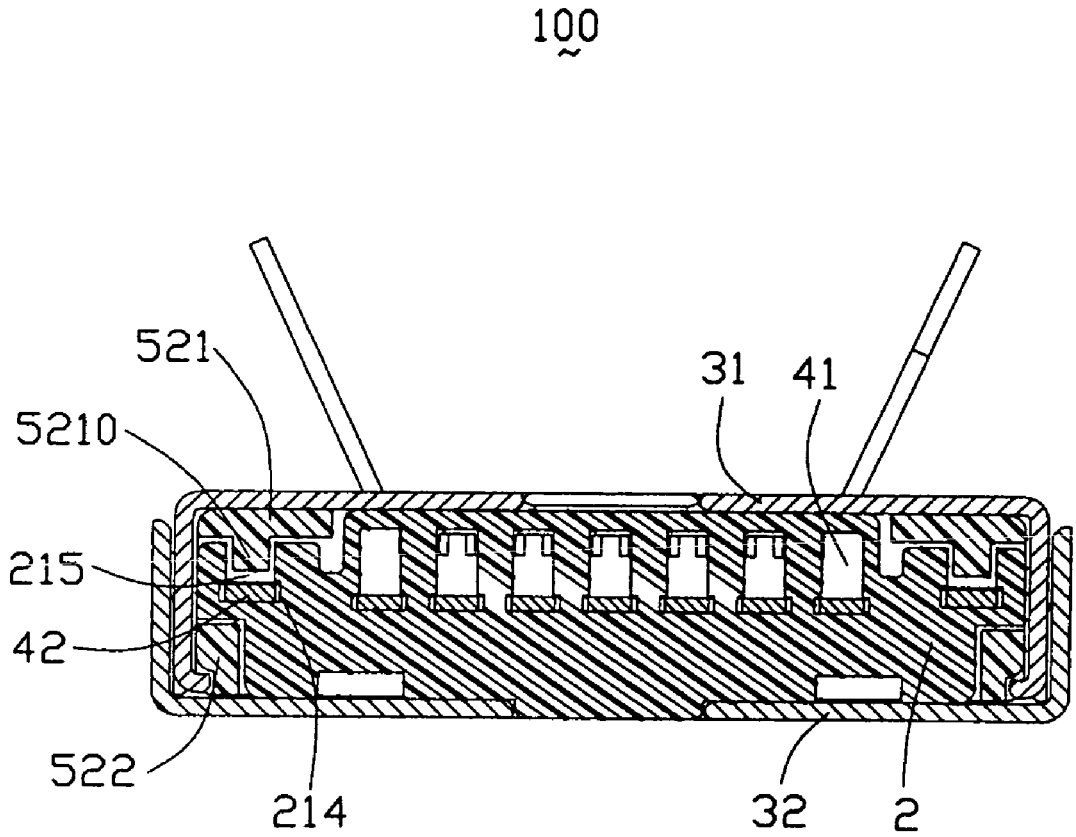

Referring to FIGS. 4-5 in conjunction with FIGS. 6-7, the second housing 6 of the board end connector 200 comprises a main portion 60, a tongue portion 62 extending forwardly from the main portion 60, and a pair of side portions 64 connecting with opposite ends of the main portion 60 and located at opposite sides of the tongue portion 62. Each side portion 64 has a U-shape first section 641 extending beyond the front surface of the main portion 60, a middle section 643 connecting with the main portion 60, and an L-shape second section 642 extending beyond the rear surface of the main portion 60. A plurality of first passageways 600 are defined through the main portion 60 and a pair of second passageways 640 are defined through the middle sections 643 of the side portions 64. The tongue portion 62 defines a plurality of first receiving channels 620 with different lengths. A pair of second receiving channels 644 are defined in the upper portions of the U-shape first sections 641 of the side portions 64. That is to say, the first and second receiving channels 644 are arranged to locate in different planes along vertical direction. A pair of rectangular extrusions 6420 are respectively formed on upper surfaces of the second sections 642 of the side portions 64. A slot 645 is defined in outer periphery of each side portion 64. A plurality of ribs 65 extend forwardly from the bottom edge of the middle section 643 of side portions 64 and form a gap 650 between the first sections 641 of the side portions 64 and the tongue portion 62.

The contacts 7 of the board end connector 200 consist of a plurality of first contacts 71 having same structure and comprising two pairs of differential pairs for signal transmission and three grounding pieces located at opposite sides of the differential pairs and a pair of second contacts 72 located at outmost sides of the first contacts 71 for power transmission. The second contact 72 has bigger size than that of the first contact 71 and is located at a higher level than that of the first contact 71. Each contact 71 comprises a mating section 70, an interferential section 73 extending from the mating section 70, and a soldering section 74 bending downwardly then flatly from the interferential section 73 for being surface-mounted to the printed circuit board 9.

When the contacts 7 are assembled to the second housing 6, the contacts 7 respectively protrude through the first and second passageways 600, 640 with the mating sections 70 respectively located in the first and second receiving channels 620, 644 and the interferential sections 73 engaging with the first and second passageways 600, 640 for retaining the contacts 7 in the second housing 6. After assembly, the grounding pieces of the first contacts 71 are located closer to the front edge of the tongue portion 62 than the differential pairs for reliable signal transmission.

The shielding member 8 of the board end connector 200 is U-shape and comprises a top wall 80, a bottom wall 81 opposite to the top wall 80, and a pair of lateral walls 82 extending downwardly from the top wall 80. The top wall 80 forms a pair of first spring fingers 800 and a pair of cutouts 802 receiving the pair of extrusions 6420 of the second housing 6 for positioning the shielding member 8 to the second housing 6. The bottom wall 81 forms a pair of second spring fingers 810 corresponding to the first spring fingers 800 and the rear edge thereof is inserted into the gap 650 of the second housing 6. Each lateral wall 82 forms a pressing tab 820 locking into the slot 645 for securing the shielding member 8. Each lateral wall 82 forms a pair of legs 822 for positioning the shielding member 8 to the printed circuit board 9. A plurality of spring tabs 83 are formed with the front edges of the walls 80, 81, 82 and bend vertically and outwardly from the edges. Each spring tab 83 is formed with a bump 830 for increasing the spring force when abutting against a panel to which the board end connector 200 is mounted.

Figure 2:
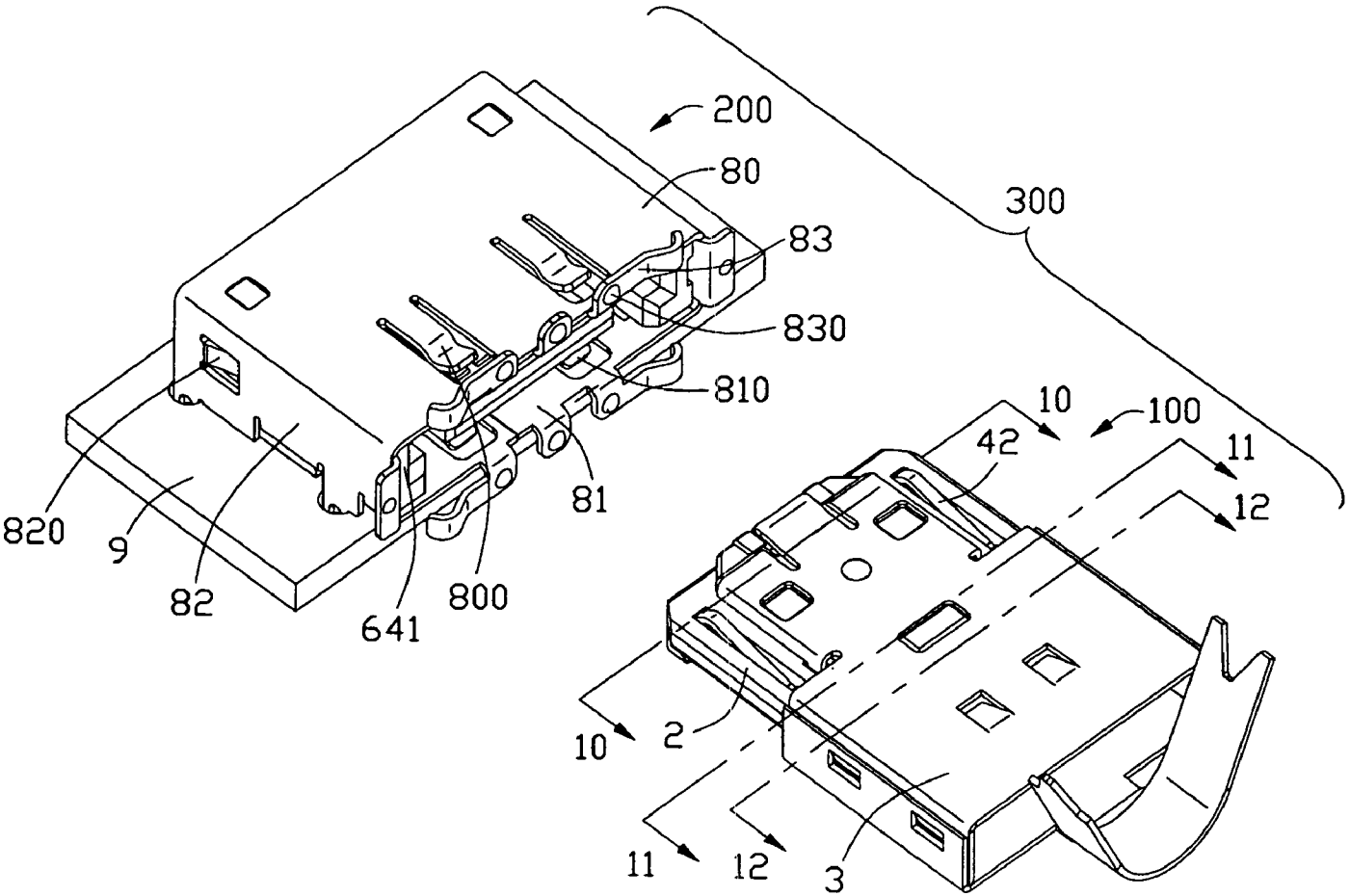
FIGS. 2-3 are views similar to FIG. 1, but viewed from different aspects.
Figure 3:
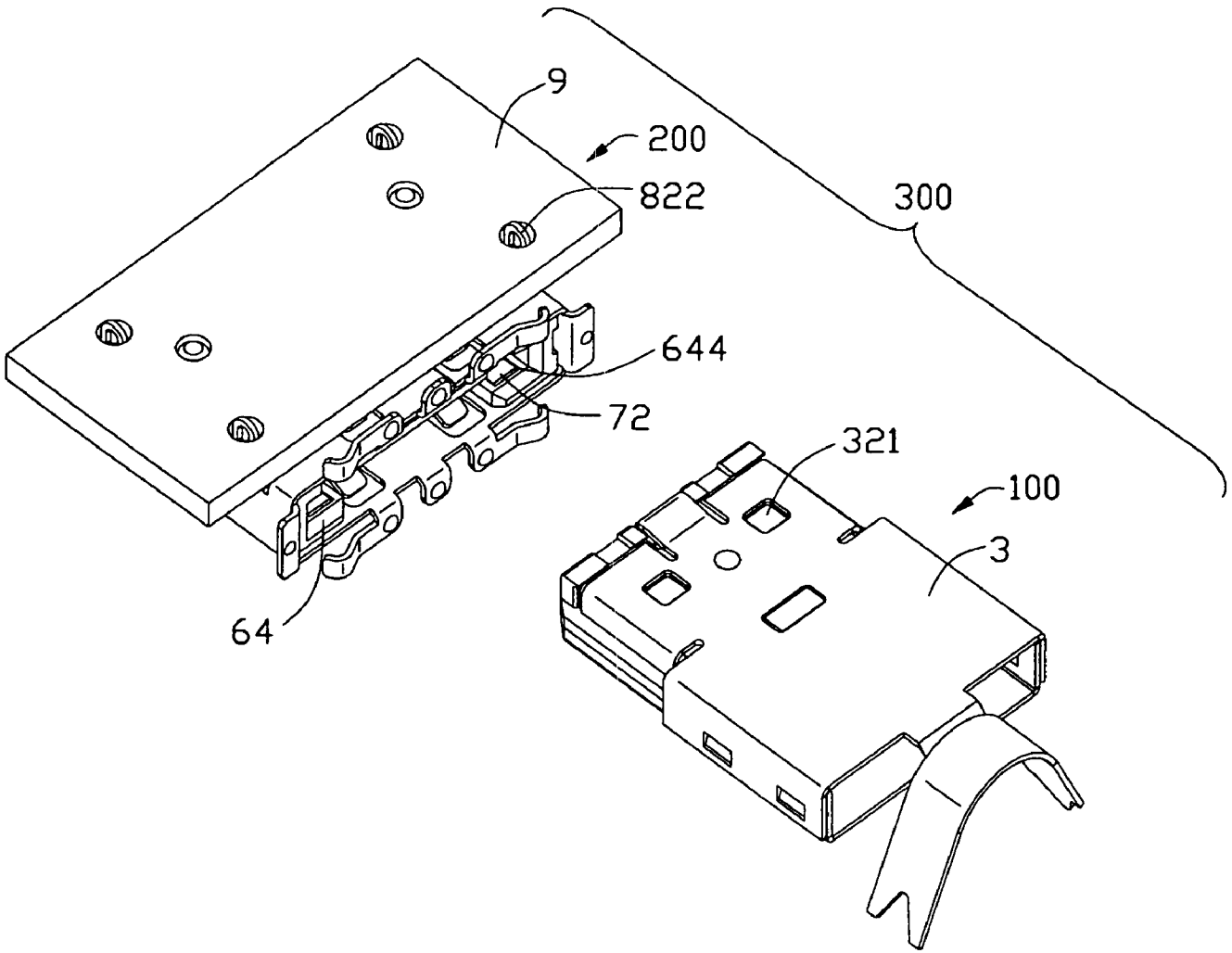

Referring to FIGS. 1-3 in conjunction with FIG. 13, when the plug connector 100 and the board end connector 200 are assembled to each other, the guiding posts 230 of the plug connector 100 slide along the U-shape first sections 641 of the side portions 64 of the second housing 6 for guiding the plug connector 100 into the board end connector 200. The tongue portion 62 of the second housing 6 is received into the receiving space 20 of the first housing 2 with the mating sections 70 of the first contacts 71 mating with the curved mating portions 40 of the first terminals 41 exposed in the receiving space 20, while the mating sections 70 of the second contacts 72 mating with the curved mating portions 40 of the second terminals 42 exposed beyond the upper surface of the upper wall 21 of the first housing 2. The first and second front portions 310, 320 are respectively inserted between the space formed by the upper and lower walls 80, 81 of the shielding member 8 and the tongue portion 62 with the first and second spring fingers 800, 810 pressing into the first and second notches 311, 321 and the first and second grooves 2110, 2210. At the same time, the first and second spring pieces 313, 323 abut against inner surfaces of the upper and lower walls 80, 81 for increasing retaining force between the conductive shell 3 and the shielding member 8.

When the plug connector 100 mates with another board end connector (not shown) which has the same dimension as that of the board end connector 200 and has no the pair of second contacts 72, the pair of second terminals 42 of the plug connector 100 will be left free from mating with any contacts. That is to say, the plug connector 100 may be compatible with two different board end connectors in different circumstances while keeping the same dimension as original design without the pair of second terminals.

Of course, the board end connector 200 also may be compatible with different plug connectors with the same dimension as each other and with or without the second contacts 72 in different circumstances.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting with an electronic element and capable of mating with at least one of the first and second complementary connectors to form electrical connection between the electronic element and the complementary connectors, comprising:

a housing comprising an upper wall, a lower wall opposite to the upper wall, and a pair of sidewalls connecting with the upper and lower walls, the housing defining a receiving space circumscribed by the upper wall, the lower wall and the sidewalls;

a plurality of first terminals assembled to the upper wall of the housing; and at least one second terminal assembled to the housing; and wherein each of the first and second terminals comprising a mating portion, an intermediate portion engaging with the housing to retain the first and second terminals in the housing and a tail portion adapted for electrically connecting with the electronic element; and wherein the mating portions of the first terminals are exposed beyond the inner surface of the upper wall and exposed into the receiving space of the housing adapted for mating with the first complementary connector, and the mating portion of the at least one second terminal is exposed beyond the outer surface of the housing adapted for mating with the second complementary connector together with the first terminals.

2. An electrical connector adapted for mating with at least one of the first and second complementary connectors having same dimension, comprising:

a housing;

a first set of terminals for signal transmission assembled to the housing;

a second set of terminals for grounding the first set of terminals when signal transmission and assembled to the housing; and a third set of terminals for power transmission assembled to the housing; and wherein the first set and second set of terminals are always in use when the electrical connector mating with at least one of said first and second complementary connectors, while the third set of terminals are in use when the electrical connector mating with the first complementary connector and are not in use when the electrical connector mating with the second complementary connector.

* * * * *